US005878840A

United States Patent [19]

Tessum et al.

[11] Patent Number: 5,878,840

[45] Date of Patent: Mar. 9, 1999

[54] APPARATUS AND METHOD FOR STABILIZING A SCAFFOLD ASSEMBLY

[76] Inventors: Mark Reed Tessum, 414 Craven Dr., Suisun City, Calif. 94585; Robert Eugene Lynch, 14633 Shakeridge Rd., Sutter Creek, Calif. 95685

[21] Appl. No.: 851,743

[22] Filed: May 6, 1997

[51] Int. Cl.[6] ..... E04G 5/00

[52] U.S. Cl. ..... 182/229

[58] Field of Search ..... 182/229, 214, 182/129; 248/229.13, 230.4

[56] References Cited

U.S. PATENT DOCUMENTS

| | | | |
|---|---|---|---|
| Re. 27,053 | 2/1971 | Capozzi et al. | 182/87 |
| 529,745 | 11/1894 | McIntyre . | |
| 596,151 | 12/1897 | Funcke . | |
| 698,572 | 4/1902 | Smith . | |
| 1,211,868 | 1/1917 | More et al. . | |
| 1,890,029 | 12/1932 | Delfs . | |
| 2,854,291 | 9/1958 | Riblet | 304/10 |
| 3,372,771 | 3/1968 | Capozzi et al. | 182/229 |
| 3,468,399 | 9/1969 | Lloyd | 182/229 |
| 4,170,356 | 10/1979 | Banks | 248/541 |

FOREIGN PATENT DOCUMENTS

| | | | |
|---|---|---|---|
| 1434360 | 10/1969 | Germany | 182/229 |
| 2249687 | 11/1972 | Germany | 182/229 |

*Primary Examiner*—Alvin Chin-Shue

*Attorney, Agent, or Firm*—Townsend and Townsend and Crew

[57] ABSTRACT

A clamp assembly for interengaging a wall with a stanchion of a scaffold assembly. The clamp assembly includes a pair of jaws pivotally secured to each other for clamping the stanchion of the scaffold assembly. Each of the jaws has an opening. A rod is provided for engaging the wall to secure and couple the scaffold assembly to the wall. The clamp assembly further includes a bolt with an eyelet where-through the rod passes. The bolt passes through each of the openings of the two jaws of the clamp assembly. The rod, while being engaged in the eyelet of the bolt, is stationarily affixed against one of the jaws simultaneously with securedly engaging and clamping the two jaw members around the stanchion. A method for stabilizing a scaffold assembly next to a wall.

6 Claims, 7 Drawing Sheets

APPARATUS AND METHOD FOR STABILIZING A SCAFFOLD ASSEMBLY

BACKGROUND OF THE INVENTION

1. Field of the Invention

This invention relates to a clamp assembly for coupling and/or interengaging a scaffold assembly with a wall of a building. More specifically, this invention provides a clamp assembly and method for stabilizing a scaffold assembly next to a wall or roof of an edifice so that the scaffold assembly will not inadvertently tip over.

2. Description of the Prior Art

A patentability investigation was conducted and the following U.S. Patents were discovered:

- U.S. Pat. No. : 27,053—titled: SCAFFOLD HOLDER, Capozzi et al
- U.S. Pat. No. : 529,745—titled: SCAFFOLD AND SCAFFOLD CLAMP, J & J. G. McIntyre
- U.S. Pat. No. : 596,151—titled: LADDER SCAFFOLD, Funcke
- U.S. Pat. No. : 1,211,868—titled: SCAFFOLDING, Pettigrew
- U.S. Pat. No. : 1,890,029—titled: SCAFFOLD, Delfs
- U.S. Pat. No. : 2,854,291—titled: SCAFFOLD APPARATUS, Riblet
- U.S. Pat. No. : 3,372,771—titled: SCAFFOLD HOLDER, Capozzi et al
- U.S. Pat. No. : 3,468,399—titled: SCAFFOLD LEDGER SUPPORT, Lloyd U.S. Pat. N0. Re. 27,053 to Capozzi et al that teaches a scaffold holder which is formed by a cylindrical housing having a threaded cylindrical housing portion for threadably receiving a threaded portion of a screw. The cylindrical housing is also provided within an adjustable support. The support includes a plurality of holes which are for receiving an adjustment pin for securing a chain adjustment panel within the support.

U.S. Pat. No. 529,745 to McIntyre et al teaches an improved clamp which is attached to the front end of a log such that the clamp may be secured to an upright member.

U.S. Pat. No. 596,151 Funcke discloses a ladder scaffold vertically arranged. A supporting-arm is secured to the ladder and is braced to prevent lateral movement. Each of the disclosed ladders are properly coupled to the face of a wall of a building by suitable connections.

U.S. Pat. No. 1,211,868 to More et al discloses a scaffold consisting of a plurality of spaced uprights and a plurality of channel bars extending horizontally from the uprights to a building wall in order to support a floor.

U.S. Pat. No. 1,890,029 to Delfs teaches bars secured to a scaffold ladder by hooks. The bars are for properly spacing the scaffold ladder from a building. The scaffold ladder is secured to the building by an anchor boat which is adapted to be driven into a wall of the building. A chain-turnbuckle combination couples the anchor boat to the scaffold ladder.

U.S. Pat. No. 2,854,291 to Riblet teaches a scaffold apparatus wherein rods couple the scaffold to a wall by passing through a box like structure which is slidable on an upright portion.

U.S. Pat. No. 3,372,771 to Capozzi et al is the same scaffold holder which was previously described in U.S. Pat. No. Re. 27,053 to Capozzi et al.

U.S. Pat. No. 3,468,399 to Lloyd discloses and describes a ledger support member having a wall penetrating threaded point at one end which screws directly into a structure of a building by rotating the entire member. The other end of a ledger support member is secured to an element that surrounds an upright member.

None of the foregoing U.S. Patents teach or suggest the clamp assembly and method of the present invention.

SUMMARY OF THE INVENTION

The present invention accomplishes its desired objects by broadly providing a clamp assembly for interengaging (e.g. a wall, ceiling, etc.) and a support and stanchion of a scaffold assembly. The clamp assembly includes a first jaw means for engaging a stanchion of a scaffold assembly and including a first opening. A second jaw means is provided as having a second opening and being pivotally connected to the first jaw means for engaging the stanchion of the scaffold assembly. The clamp assembly further includes a rod means for engaging a support in order to secure and couple the scaffold assembly to the support, and a bolt means, engaged to the rod means and passing through the first opening and through the second opening, for stationarily affixing the rod means against the first jaw means while simultaneously securedly engaging the first jaw means and the second jaw means around the stanchion in order to clamp the same. The first jaw means includes a structure defining at least one pair of recesses separated by the first opening. The second opening of the second jaw means is defined by a structure of the second jaw means terminating in a bifurcated fork. The bolt means terminates in an eyelet where through the rod means passes.

The present invention further accomplishes its desired objects by providing a clamp assembly for coupling a scaffold assembly to a wall. The clamp assembly comprises a first jaw member, a second jaw member pivotally connected to the first jaw member, and a bolt member having an eyelet and releasably engaged to the first jaw member and to the second jaw member. The clamp assembly further includes a rod slidably passing through the eyelet of the bolt member. The first jaw member has a first opening and an eyelet recess terminating in the first opening. The first jaw member also has at least one pair of rod-receiving recesses separated by the eyelet recess. The second jaw member has a second opening. Preferably, the bolt member passes through the first opening and through the second opening.

The present invention further also accomplishes its desired objects by providing a method for coupling a scaffold assembly to a wall comprising the steps of:

a) providing a scaffold assembly with a stanchion;

b) securing a rod to a wall member that is generally in close proximity to the stanchion of the scaffold assembly;

c) passing the rod of step (b) through an eyelet of a bolt member;

d) generally surrounding the stanchion with a clamp assembly comprising a first jaw member having a first opening and a second jaw member pivotally connected to the first jaw member and having a second opening;

e) passing the bolt member of step (c) through the first opening of the first jaw member and through the second opening of the second jaw member;

f) engaging the bolt member of step (e) with a nut member; and g) tightening the nut member on the bolt to cause the first jaw member and the second jaw member to securely clamp the stanchion simultaneously with securely flushing the rod against the first jaw member.

The immediate foregoing method for coupling a scaffold assembly to a wall preferably additionally comprises at least partially seating the eyelet in an eyelet recess in the first jaw member and seating the rod of step (c) in a pair of first recesses on the first jaw member.

The present invention yet further also accomplishes its desired objects by providing a method for stabilizing a scaffold assembly next to a wall comprising the steps of:

a) providing a scaffold assembly with a stanchion;

b) securing a rod to a wall member;

c) disposing the stanchion of step (a) between a first jaw member and a second jaw member;

d) providing a means for forcing the first jaw member and the second jaw member towards each other and against the stanchion to clamp the stanchion between the first jaw member and the second jaw member;

e) releasably engaging the rod of step (b) to the means for forcing of step (d);

f) forcing with the means for forcing of step (d) the first jaw member and the second jaw member towards each other and against the stanchion, simultaneously with forcing the rod against the first jaw member, to clamp the stanchion between the first jaw member and the second jaw member and to affix the rod against the first jaw member in order to stabilize the scaffold assembly next to the wall member.

It is therefore an object of the present invention to provide an clamp assembly for interengaging a wall or support member and a stanchion of a scaffold assembly.

It is another object of the present invention to provide a method for coupling a scaffold assembly to a wall.

It is also another object of the present invention to provide a method for stabilizing a scaffold assembly next to a wall.

These, together with various ancillary objects and features which will become apparent to those skilled in the art as the following description proceeds, are attained by this novel apparatus and method, a preferred embodiment thereof shown with reference to the accompanying drawings, by way of example only, wherein:

DETAILED DESCRIPTION OF PREFERRED EMBODIMENTS OF THE INVENTION

Figure 1A:
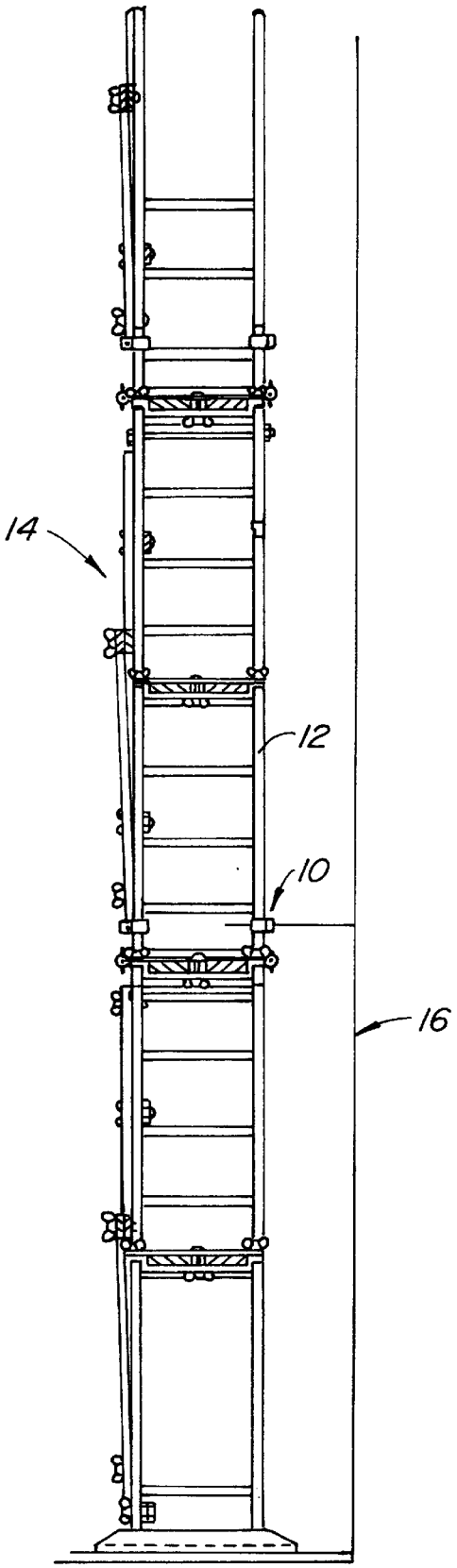
FIG. 1A is a conventional scaffold assembly having the clamp assembly of the present invention connected thereto and also connected to a wall of a building in order to stabilize the scaffold assembly next to the wall.
Figure 1B:
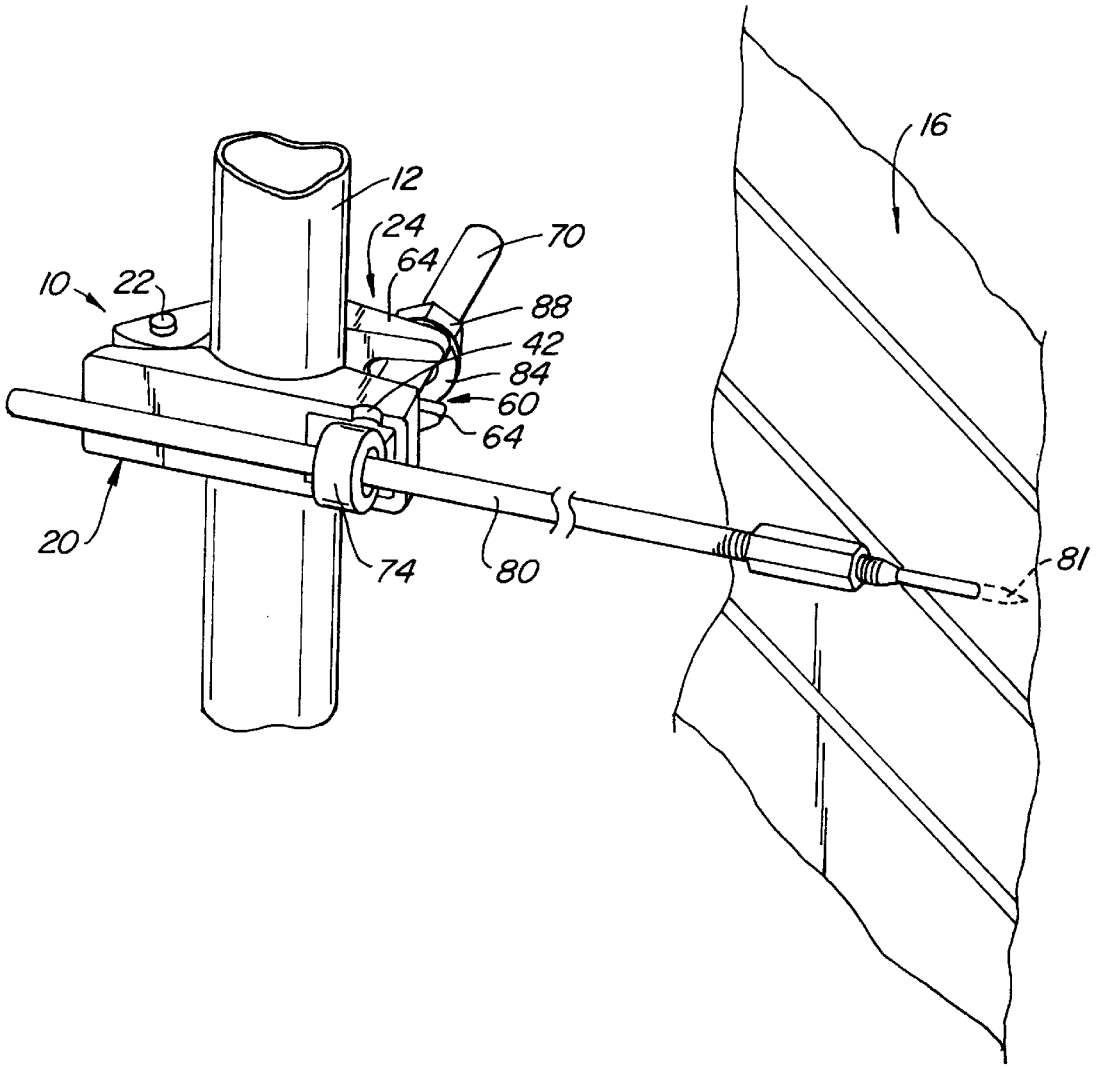
FIG. 1B is a partial perspective view of the clamp assembly of the present invention engaged to a stanchion of the scaffold assembly and releasably engaged or connected to the wall of the building.
Figure 7:
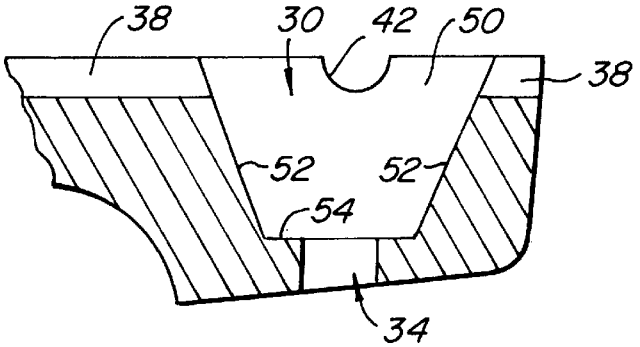
FIG. 7 is a horizontal sectional view taken in direction of the arrows and along the plane of line 7—7 in FIG. 6.
Figure 8:
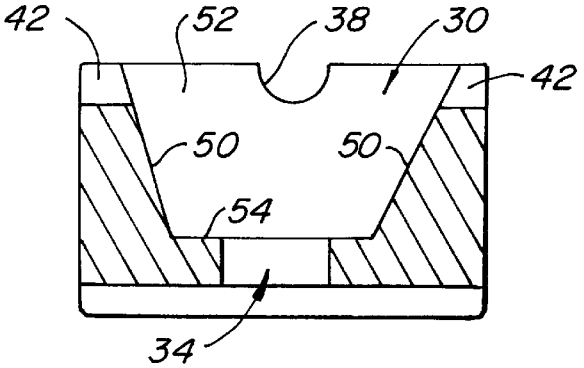
FIG. 8 is a vertical sectional view taken in direction of the arrows and along the plane of line 8—8 in FIG. 6.
Figure 9:
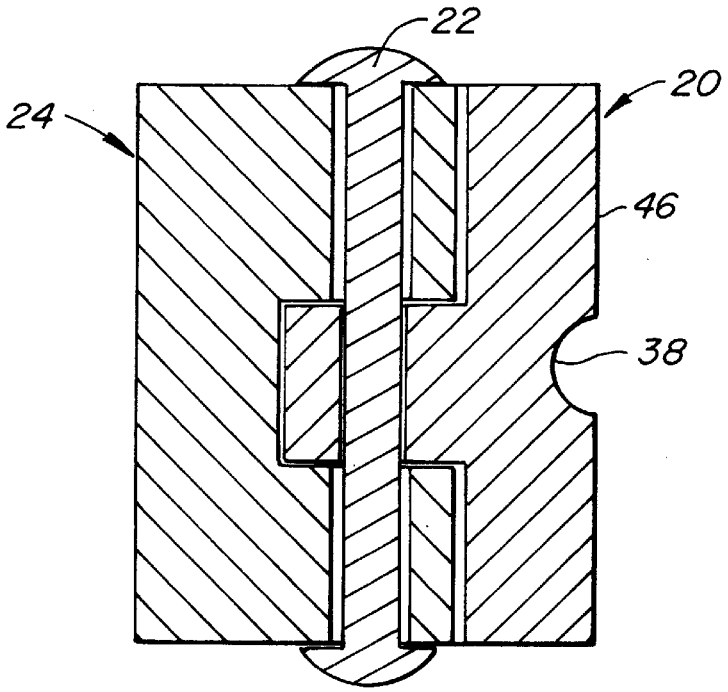
FIG. 9 is a vertical sectional view taken in direction of the arrows and along the plane of line 9—9 in FIG. 2.
Figure 10:
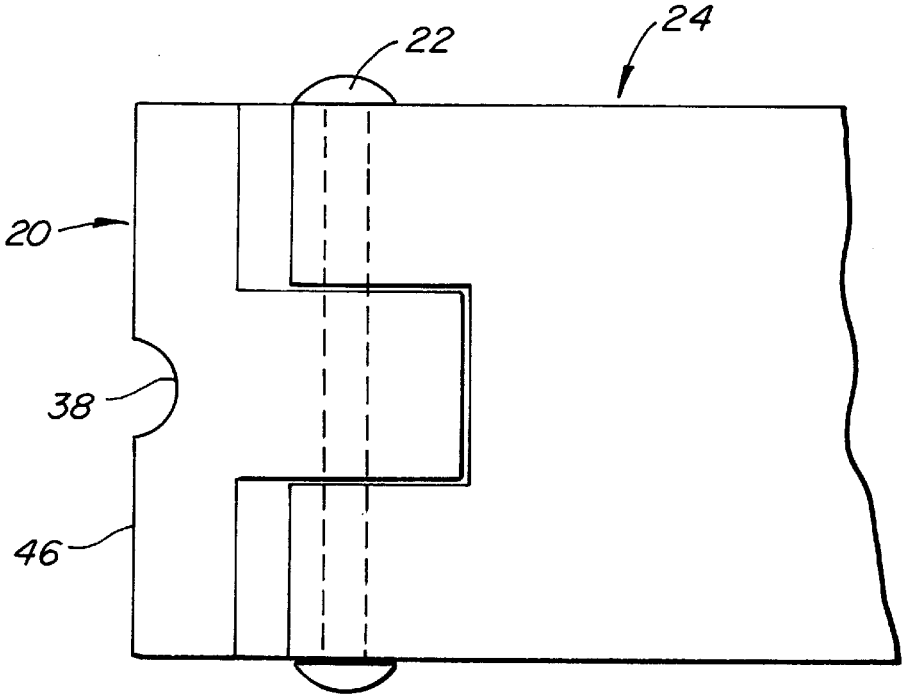
FIG. 10 is an elevational view of the clamp assembly taken in direction of the arrows and along the plane of line 10—10 in FIG. 2.

Referring in detail now to the drawings wherein similar parts of the invention are identified by like reference numerals, there is seen a clamp assembly, generally illustrated as 10, for coupling a stanchion 12 of a conventional scaffold assembly, generally illustrated as 14 in FIG. 1, to a wall 16 in order to stabilize the scaffold assembly 14 and prevent the scaffold assembly 14 from tipping over. The clamp assembly 10 includes a jaw generally illustrated as 20. Jaw 20 is pivotally connected by pin 22 to a jaw, generally illustrated as 24. Jaw 20 includes an eyelet recess 30 terminating in an opening 34. Two pairs of rod-receiving recesses 38—38 and 42—42 are formed on a generally planar face 46 of the jaw 20 and are separated by the eyelet recess 30. As best shown in FIGS. 7 and 8, the eyelet recess 30 includes a pair of downwardly slanting sidewalls 50—50 and downwardly slanting endwalls 52—52, all of which merge with a bottom 54 through which the opening 34 passes in order to communicate with the eyelet recess 30.

Figure 3:
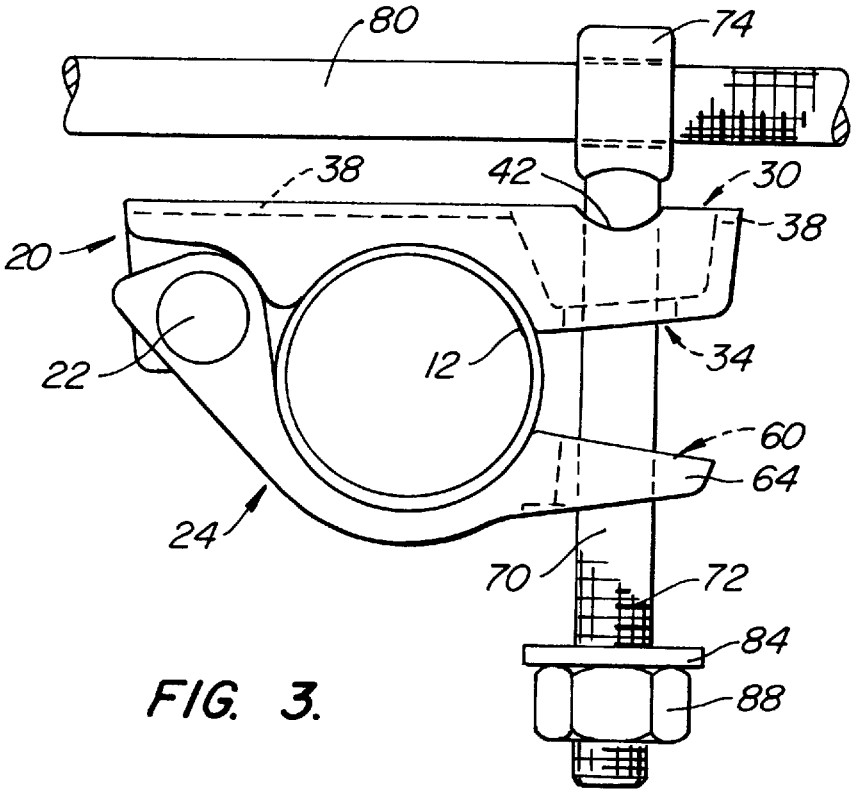
FIG. 3 is a top plan view of the clamp assembly of FIG. 2 after the bolt member has passed through the opening of the two jaw members and after the nut has threadably engaged the bolt member.
Figure 4:
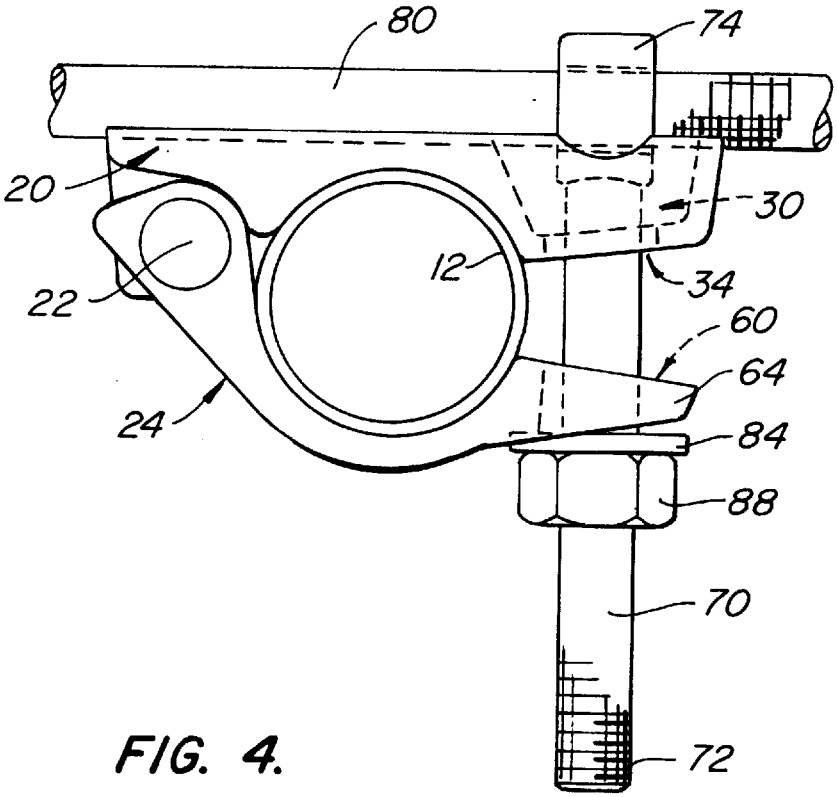
FIG. 4 is a top plan view of the clamp assembly of FIG. 3 after the nut has been tightened sufficiently to force the two jaw members against the stanchion in order to clamp the stanchion while simultaneously having the rod member forced against one of the jaw members while being seated in a pair of rod-receiving recesses within one of the jaw members.
Figure 5:
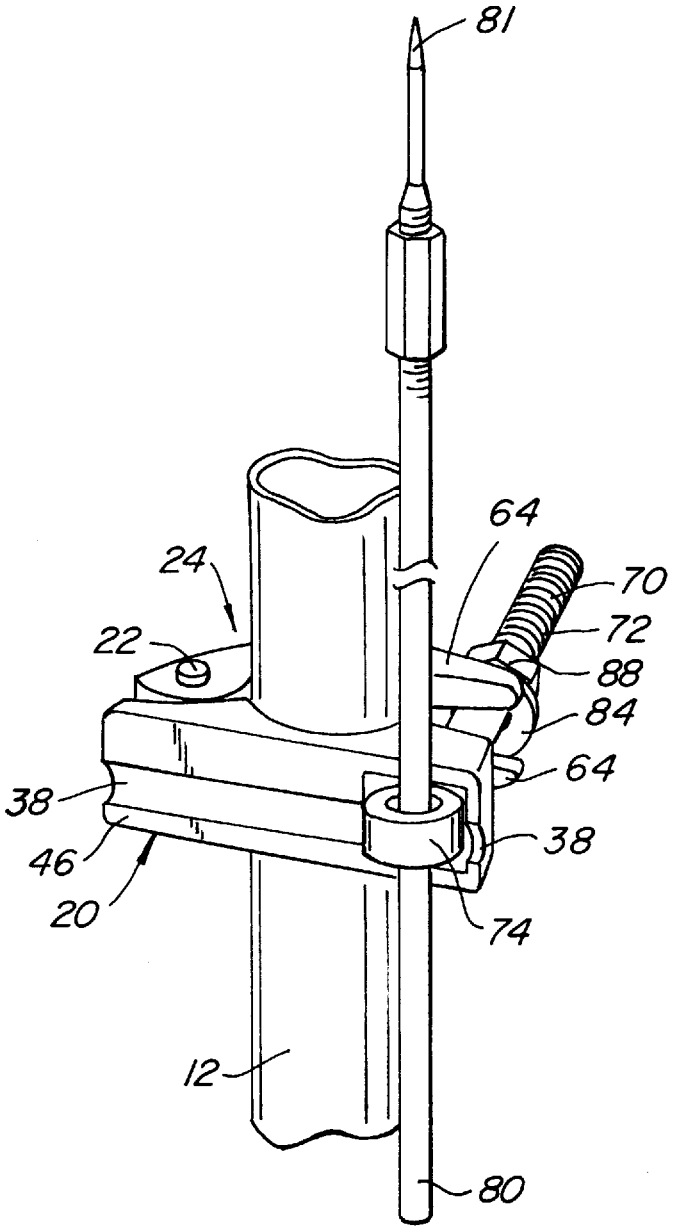
FIG. 5 is a partial perspective view of the clamp assembly with the rod member being generally normal with respect to the body of the clamp assembly for engaging a roof or any other structure that is above the stanchion of the scaffold assembly.
Figure 6:
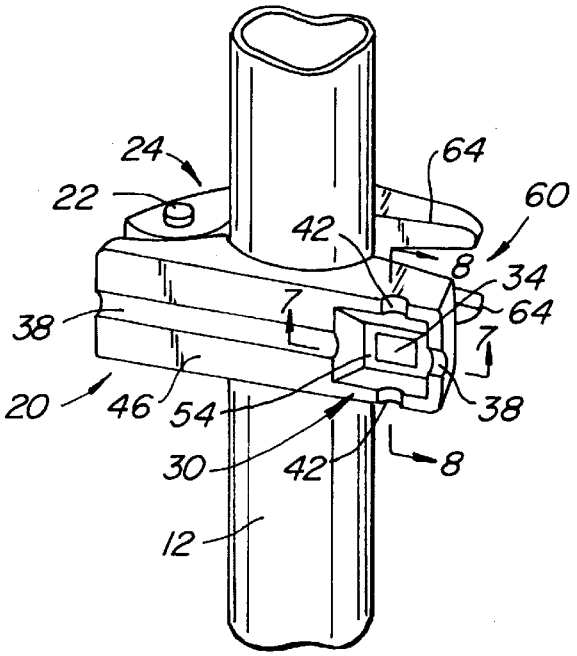
FIG. 6 is a partial perspective view of the clamp assembly of FIG. 5 after the bolt and rod member has been removed therefrom.

Jaw 24 has an opening 60 which is formed by a pair of bifurcated spaced forks member 64—64. A bolt is provided for passing through opening 34 of jaw 20 and opening 60 of jaw 24. Bolt 70 has a threaded part 72 and an eyelet 74 wherethrough a rod 80 slidably passes. Rod 80 is formed with a point 81 (see FIGS. 1B and 5B) which is for being implanted into the wall 16 to stabilize the scaffold assembly 14 when rod 80 is affixed and flushed tightly against the jaw 20. A washer 84 and nut 88 respectively conveniently engage and threadably connect to bolt 70 as shown in FIGS. 3 and 4 after the bolt 70 passes through opening 34 of jaw 20 and through opening 60 of jaw 24. The rod 80 passes through eyelet 74 of the bolt 70 such that point 81 may be driven into the wall 16. As the nut 88 is being fully tightened down as shown in FIG. 4 while rod 80 passes through eyelet 74 and seats in rod-receiving recesses 38—38 (see FIG. 4 again), or seats in rod-receiving recesses 42—42 (as shown in FIG. 5), rod 80 becomes essentially immobilized while engaged to a stationary structure such as wall 16; thus, the scaffold assembly 14 becomes stabilized and can not easily tip over.

Continuing to refer in detail to the drawings for operation of the invention and for the methods for coupling a scaffold assembly (e.g. scaffold assembly 14) to a wall, such as wall 16, the scaffold assembly 14 is provided or is obtained with at least one stanchion 12 or the like. Rod 80 is secured to the wall 16 by shooting or otherwise impelling point 81 into the wall 16. Subsequently, rod 80 is passed through the eyelet 74 of the bolt 70. Alternatively, the rod 80 may be passed through the eyelet 74 first and before being driven into wall 16.

Figure 2:
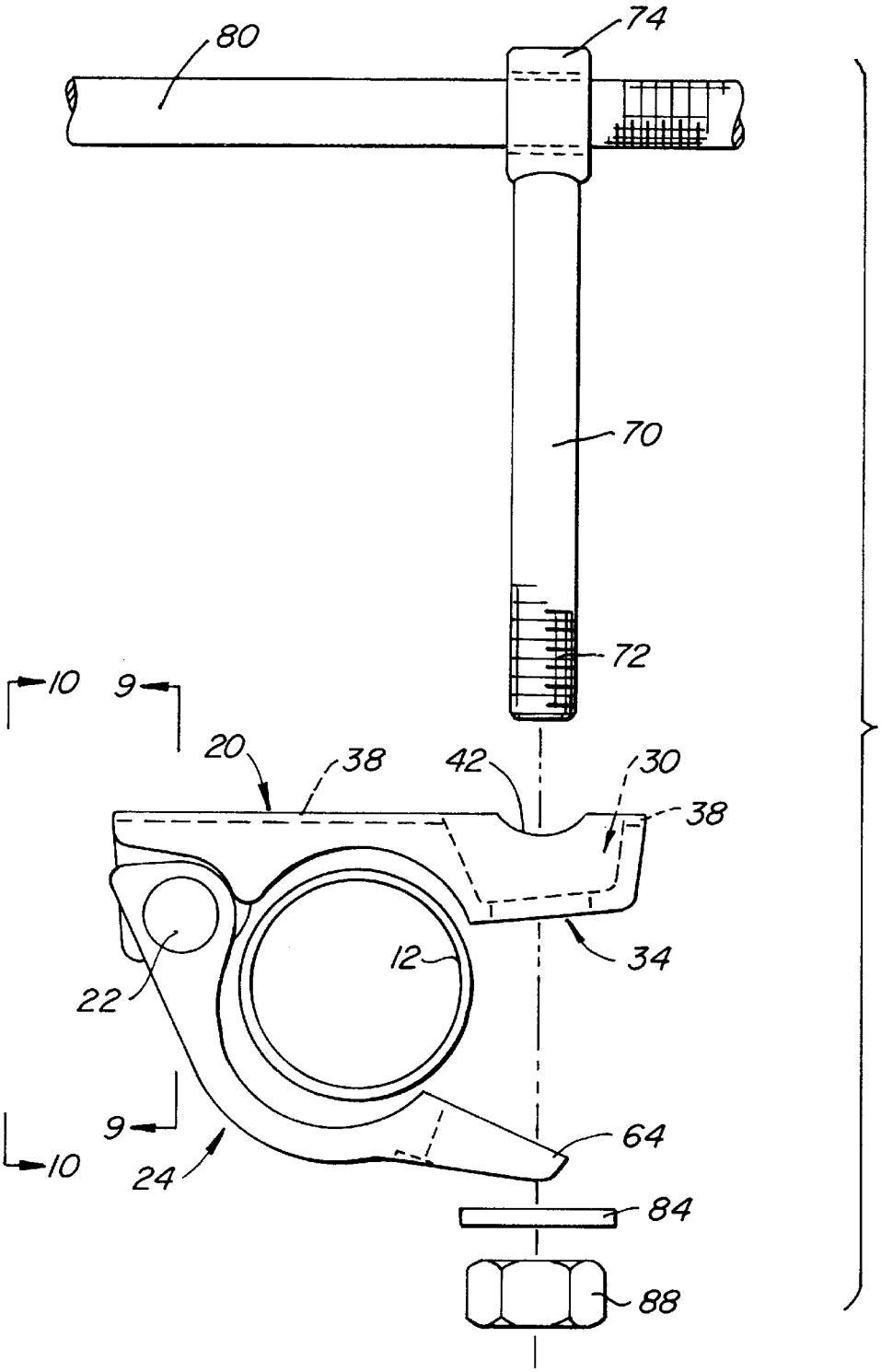
FIG. 2 is a segmented top plan view of the clamp assembly showing the rod slidably passing through the eyelet of the bolt member with the bolt member aligned with the openings of the two jaw members such that when the nut is tightened on the bolt member, the two jaw members are pulled and forced towards each other to clamp the stanchion while simultaneously causing the rod member to be pulled by the bolt against one of the jaw members.

Subsequently and as best shown in FIG. 2., jaws 20 and 24 are loosely encircled around the stanchion 12 such as to generally surround the same. The pivotally secured jaws 20 and 24 are then adjusted such that the bolt 70 passes through the eyelet recess 30, the opening 34, and then through the opening 60 as shown in FIGS. 2 and 3. Washer 84 is placed around the bolt 70 and then nut 88 threadably engages the threaded part 72 of the nut 88 as best shown in FIG. 3. The nut 88 is fully tightened down against the washer 84 (see FIG. 4) to cause the jaws 20 and 24 to securely clamp the stanchion 12, simultaneously causing rod 80 to securely flush against the jaw 20, again as best shown in FIG. 4. The eyelet 74 of the bolt 70 seats and lodges in the eyelet recess 30 of the jaw 20. Simultaneously with the eyelet 74 seating in the eyelet recess 30, the rod 80 seats in the rod-receiving recesses 38—38 or in the rod receiving recess 42—42 as shown is FIG. 5. The distance or amount of seating that eyelet 74 does within eyelet recess 30 depends on the depth of rod-receiving recesses 38—38 and the amount of tightening down on nut 88. Obviously, the deeper rod-receiving recesses 38—38 or rod-receiving recesses 42—42, the further down that the eyelet 74 would pass into or seat within eyelet recess 30. The nut 88 functions as a means for forcing the jaws 20 and 24 toward each other and against the stanchion 12 to clamp the stanchion 12 between jaws 20 and 24. As the nut 88 tightens down against washer 84 and the tightening-down force is imparted against the bifurcated forks 64—64 of jaw 24, the jaws 20 and 24 are forced toward each other and against the stanchion 12. Simultaneously therewith, and as previously indicated, rod 80 is forced against the jaw 20. When nut 88 is completely tight, jaws 20 and 24 have clamped the stanchion 12 therebetween and the rod 80 has been affixed against the jaw 20 in order to stabilize the scaffold assembly 14 next to the wall 16.

Therefore, while the present invention has been described herein with reference to the particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A method for coupling a scaffold assembly to a wall comprising the steps of:

a) providing a scaffold assembly with a stanchion;

b) securing a rod to a wall member that is generally in close proximity to the stanchion of the scaffold assembly;

c) passing the rod of step (b) through an eyelet of a bolt member;

d) generally surrounding the stanchion with a clamp assembly including a first jaw member with a first opening and a second jaw member pivotally connected to the first jaw member and having a second opening;

e) passing the bolt member of step (c) through the first opening of the first jaw member and through the second opening of the second jaw member;

f) engaging the bolt member of step (e) with a nut member; and g) tightening the nut member on the bolt to cause the first jaw member and the second jaw member to securely clamp the stanchion simultaneously with securely flushing the rod against the first jaw member h) foaming a point on said rod prior to said securing step (b) and shooting said rod into said wall member.

2. The method of claim 1 additionally comprising at least partially seating the eyelet in an eyelet recess in said first jaw member.

3. The method of claim 1 additionally comprising seating the rod of step (c) in a pair of first recesses in said first jaw member.

4. The method of claim 2 additionally comprising seating the rod of step (c) in a pair of first recesses in said first jaw member.

5. A method for stabilizing a scaffold assembly next to a wall comprising the steps of:

a) providing a scaffold assembly with a stanchion;

b) securing a rod to a wall member;

c) disposing the stanchion of step (a) between a first jaw member and a second jaw member;

d) providing a means for forcing the first jaw member and the second jaw member towards each other and against the stanchion to clamp the stanchion between the first jaw member and the second jaw member;

e) releasably engaging the rod of step (b) to the means for forcing of step (d);

f) forcing with said means for forcing of step (d) said first jaw member and said second jaw member towards each other and against the stanchion, simultaneously with forcing the rod against he first jaw member, to clamp the stanchion between the first jaw member and the second jaw member and to affix the rod against the first jaw member in order to stabilize the scaffold assembly next to the wall member;

g) forming a point on said rod prior to said securing step (b) and shooting said rod into said wall member.

6. The method of claim 5 additionally comprising seating the rod of step (e) in a pair of first recesses in said first jaw member.

* * * * *